US007560665B2

(12) United States Patent
Hamilton et al.

(10) Patent No.: US 7,560,665 B2
(45) Date of Patent: Jul. 14, 2009

(54) IMAGING DEVICE TEMPERATURE MANAGEMENT

(75) Inventors: Douglas Campbell Hamilton, Lexington, KY (US); Russell Edward Lucas, Lexington, KY (US); Johnny Ray Sears, Versailles, KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 11/196,021

(22) Filed: Aug. 3, 2005

(65) Prior Publication Data

US 2007/0045270 A1 Mar. 1, 2007

(51) Int. Cl.
*G03G 15/20* (2006.01)

(52) U.S. Cl. ..... 219/216; 399/69; 399/70

(58) Field of Classification Search ..... None
See application file for complete search history.

(56) References Cited

U.S. PATENT DOCUMENTS 5,436,430 A 7/1995 Baruch et al.
5,464,964 A * 11/1995 Okuda et al. ..... 219/497
5,552,874 A * 9/1996 Ohtsuka et al. ..... 219/216
6,101,345 A * 8/2000 Van Goethem et al. ..... 399/69
6,261,214 B1 7/2001 Meguriya
6,459,878 B1 10/2002 Tomoyuki et al.
6,546,223 B2 4/2003 Kishino et al.
6,795,677 B2 9/2004 Berkes et al.
6,807,386 B2 * 10/2004 Yasui et al. ..... 399/69
6,823,150 B1 11/2004 Cao et al.
6,865,351 B2 3/2005 Gogate et al.
6,879,803 B2 4/2005 Gogate et al.
6,952,540 B2 * 10/2005 Uchiyama ..... 399/69
6,968,137 B2 * 11/2005 Tatematsu et al. ..... 399/69
2003/0063916 A1 * 4/2003 Katayanagi et al. ..... 399/328
2003/0091360 A1 * 5/2003 Onodera et al. ..... 399/69
2003/0230561 A1 * 12/2003 Kagawa et al. ..... 219/216
2004/0146311 A1 * 7/2004 Kawazu et al. ..... 399/69
2005/0047810 A1 * 3/2005 Nagatsuma et al. ..... 399/69
2005/0061792 A1 * 3/2005 Kagawa et al. ..... 219/216
2005/0105929 A1 5/2005 Chae et al.
2005/0207773 A1 9/2005 Nakayama et al.
2006/0078344 A1 * 4/2006 Kawazu et al. ..... 399/69
2008/0124110 A1 5/2008 Hamilton et al.

FOREIGN PATENT DOCUMENTS

JP 07-36353 A * 2/1995

OTHER PUBLICATIONS

JP 2002-328562 A, Abstract, figures, and partial translation, Japan, Nov. 2002.*
JP 2001005537 A, Abstract, Japan, Iwabayashi et al, Jan. 2001.*

* cited by examiner

*Primary Examiner*—Joseph M Pelham

(57) ABSTRACT

The present invention is directed to a method and apparatus relating to the thermal management of an image fixing device such as establishing the temperature of a component that engages with the image fixing device in an image forming apparatus.

22 Claims, 3 Drawing Sheets

IMAGING DEVICE TEMPERATURE MANAGEMENT

FIELD OF INVENTION

The present invention relates to establishing temperatures in an image forming apparatus. The image forming apparatus may include printers, including laser or electrophotographic printers and inkjet printers, copiers, faxes, all-in-one devices, or multifunctional devices.

BACKGROUND

An imaging apparatus, such as a printer, copier, fax machine, all-in-one device or a multifunctional device may include an image fixing device to fix a developing agent, such as toner, to media. The image fixing device may include a heating device such as a fuser. The fuser may have a heat source and a number of rollers or a belt and a roller that may form a nip for the media to pass through. The heat source and the rollers and/or belt may provide heat and/or pressure to the toner that may soften the toner so that the toner may adhere to the media. Improper control of temperature may lead to print defects such as low grade fusing defects, hot offset defects or paper stalls.

SUMMARY

The present invention is directed at managing the temperature in an image forming apparatus. For example, the present invention is directed to a method and apparatus relating to the thermal management of an image fixing device such as controlling the temperature of a component that engages with the image fixing device in the image forming apparatus.

BRIEF DESCRIPTION OF DRAWINGS

Features and advantages of the present invention are set forth herein by description of embodiments consistent with the present invention, which description should be considered in conjunction with the accompanying drawings, wherein.

DETAILED DESCRIPTION

The present invention relates to the management of temperature in an image fixing device. For example, the present invention provides an article and method for the thermal management of a heating device in an image forming apparatus. An exemplary embodiment of an image forming apparatus may include printers, including laser or electrophotographic printers and inkjet printers, copiers, faxes, all-in-one device, or multifunctional devices.

Figure 1:
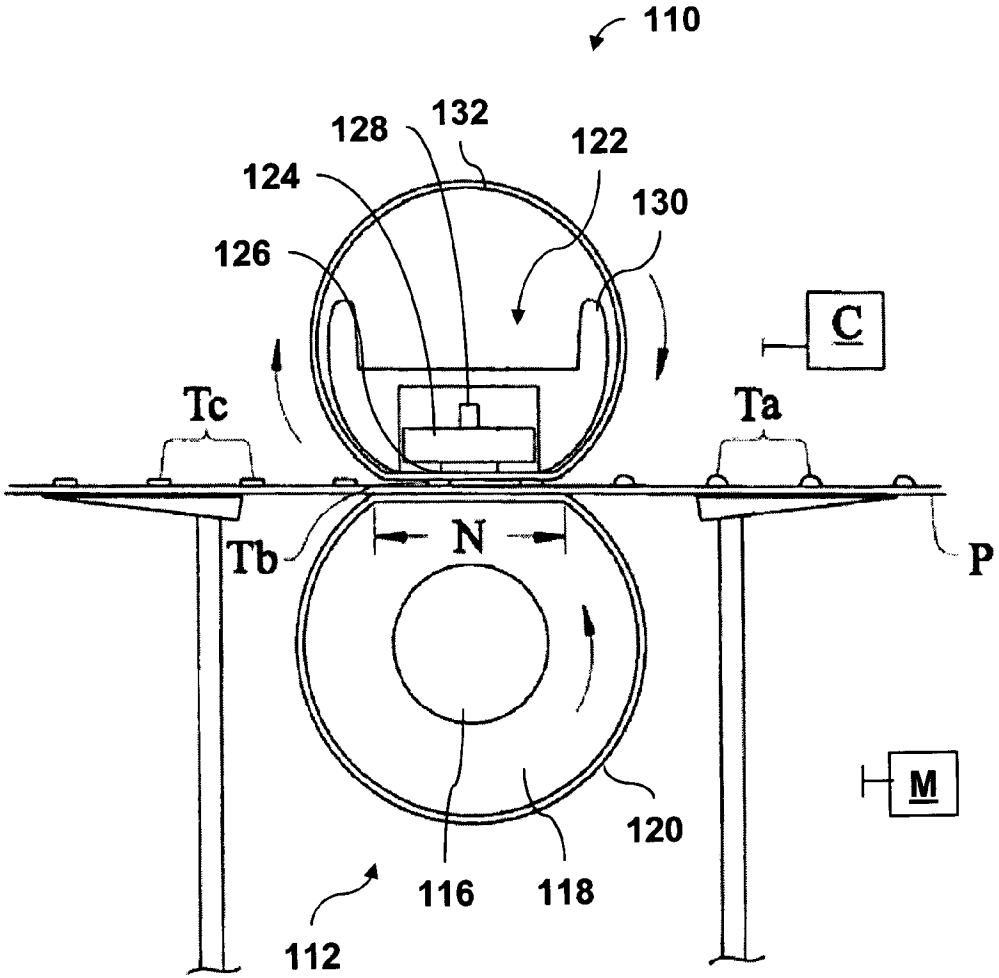
FIG. 1 is a side view of an exemplary embodiment of an image fixing device.

FIG. 1 illustrates one exemplary image fixing device 110. Any image fixing device that requires temperature management is applicable to the present invention. The image fixing apparatus may include a pressure roller 112, a heating device 122 and belt or film 132. The pressure roller 112 may include a number of configurations. For example, the pressure roller 112 may include a shaft portion 116. The shaft portion 116 may be formed from steel, aluminum, or other metallic or plastic materials. Covering the shaft portion may be a polymeric layer 118, such as a rubber or elastic layer. The polymeric layer 118 may be formed from silicon rubber or other thermoplastic or thermoset materials. Such materials may have thermal conductivities of about 0.1-4.0 watts/meter-Kelvin (W/mK).

Covering the polymeric layer 118 may be an additional layer or sleeve 120. The additional layer 120 may incorporate low energy material such as polytetrafluoroethylene (PTFE), perfluoroalkoxytetrafluoroethylene, fluorinated ethylene propylene (FEP), fluoroelastomers and other fluoropolymers and combinations of fluoropolymers and other materials. The pressure roller 112 may be driven by a motor M in communication with the pressure roller 112.

The heating device 122 may include a number of components. For example, the heating device may include a heater substrate 124, which may include one or more segments. The substrate may be composed of ceramic material. Furthermore the substrate may be electrically insulative, have a high thermal conductivity, a high heat resistance and/or a low thermal capacity. The heating device may also include one or more heat-generating electrical resistors 126. The resistors may extend along the length of the substrate 124. A temperature detecting element 128 may be included in the heating device 122. The temperature detecting element 128 may include a thermistor or a thermostat. The temperature detecting element 128 may be mounted in contact with the substrate member 124 and in one embodiment may be mounted on a surface of the substrate member 124 opposite an electrical resistor 126.

The heating device may communicate with a processor C. The processor may be a microprocessor or other processor located within the printing device or within the fixing device 122. The heating device may be fixed to a holder 130. A thin layer of electrical insulation such as glass (not shown) may cover the electrical resistors 126. A belt or film 132 may surround the heating device 122.

In one embodiment, the belt 132 may be an idling belt as the belt may be rotated by the pressure roller 112. The belt 132 may be composed of a relatively high heat resistant and durable material such as polyimide. The belt 132 may also be an endless tube and may be between 40-100 microns in thickness. The belt 132 may also include an outer layer (not illustrated) incorporating a relatively low surface energy material such as polytetrafluoroethylene (PTFE), perfluoroalkoxytetrafluroethylene, fluorinated ethylene propylene (FEP), fluoroelastomers and other fluoropolymers and combinations of fluoropolymers and other materials.

As alluded to above, the media P may pass from the developer, where a developing agent such as toner may be deposited, to the fixing device. Prior to fixing, the toner Ta may be loose on the media P. The toner and media may enter the nip (N) between the heating device 122 and the pressure roller 112. The belt 132 may be an idling belt, driven by contact with the pressure roller 112 or alternatively may be driven by driving members, such as motor M. For example, the pressure roller 112 may contact the belt 132 with about 5-20 kilograms of force. Once the media enters the nip N, the toner may be heated and may fuse to the media P, exiting the nip N in a fused state Tc.

In one embodiment the processor C, may be capable of interacting with an image fixing device including a heating device and a pressure or back-up roller. The processor may include software, hardware or firmware. When a print job is generated, the processor may recognize that there may be a print job to be printed and may also recognize the type or properties of print job.

A print job as referred to herein may be considered information or images, such as text, characters or graphics that may be printed on at least one sheet of media. Individual pages of a print job may be referred to as a print page. Properties of a print job may relate to the types of media chosen for printing, the size of the media, the type of developing agent used in the print job, the number of sheets or pages, etc. For example, a print job or a print page in a print job may be a simplex or duplex print job. A simplex may be referred to herein where images may be printed on only one side of the media. A duplex may be referred to herein where images may be printed on both sides of the media.

The processor may also communicate with a temperature detecting element 128, illustrated in FIG. 1, to detect a heating device temperature such as a fuser temperature. This is one form of information that may be sourced from the image forming apparatus. The processor may be capable of determining whether the heating device temperature is relatively warm or cold such by comparing the heating device temperature to a set point. For example, if the heating device temperature is greater than or equal to a given set point, the heating device temperature may be considered warm. If the heating device temperature is less than a given set point, the heating device temperature may be considered cold. The given set point may be any temperature. For example a desired temperature between 50 degrees Celsius and 200 degrees Celsius, and any interval therebetween including 85 degrees Celsius, 100 degrees Celsius, etc, which may be selected for any given print job. Alternatively, the set point temperature may be related to the type of media chosen for the print job or the type of developing agent, toner or whatever particular image forming substance that may used by the printing device, which may be determined when the processor detects the type of print job.

Furthermore, the processor may be capable of interacting with the heating device 122 to set or adjust the heating device temperature. The heating device temperature may be set or adjusted according to another source of information, such as the type of media chosen, the image forming substance used, the speed at which the media may pass through the heating device, the pressure that may be applied to the media during heating, etc. As the heating device, which may be a fuser, and which may include a belt, may be in proximity to the pressure roller, and may contact the pressure roller directly or indirectly (such as when media passes through the nip), adjusting the heating device temperature may directly affect the pressure roller temperature.

It should be appreciated that as the pressure roller may be composed of a polymeric material, such as an elastomeric or rubber material, the pressure roller may retain a portion of the heat energy transferred to the pressure roller from the heating device. This may be the case when one employs polymeric material which may have a relatively low thermal conductivity. Once media begins to feed through the nip, the media may begin to absorb some of the heat otherwise retained in the pressure roller and the pressure roller temperature may partially decrease. However, the pressure roller may retain an excess amount of heat in certain printing situations. The excess heat may cause, e.g., hot offset defects or papers stalls that may result from the generation of steam caused by vaporization of water (e.g., steam) out of the media.

For example purposes only, if a user were to print several short print jobs with relatively small pauses between jobs, the heating device may turn off and cool during the pause and may be forced to ramp back to the printing temperature (without media in the nip) for the next job. Each time the heating device ramps more energy is put into the pressure roller and there may be less opportunity to transfer that energy to the media and there may be a build-up in energy (heat) in the pressure roller. Such repeated ramping to higher printing temperature may cause the temperature in the pressure roller to rise to some undesirable level.

By way another non-limiting example, in the case of duplex printing, a time gap may exist between heating the front and back side of the media. The heating device may be turned off during such gap, which then may require that the heating device must ramp to a printing temperature for heating the back side. As a consequence, when the heating device ramps more energy may then be put into the pressure roller and again there may be less opportunity to transfer that energy to the media. This then may provide another exemplary case of build-up of energy (heat) in the pressure roller and the ramping of the heating device may again cause the temperature in the pressure roller to rise to detrimental levels.

Returning then to the description of the processor, it should be noted that the processor is capable of maintaining a page count. The page count may be referred to herein as the number of print pages that may have been printed in a print job, or the number of print pages that may have been printed in a number of print jobs printed in succession (i.e. a running total). At the start of a print job, the processor may clear the page count and increment the page count for every page printed. However, there may be cases where a number of print jobs have been printed in succession and the page count may not be cleared between the print jobs.

The processor may be further capable of determining whether the motors communicating with the media feeding device M were running when a print job was received. If the motor was still running, it may be possible to skip the step of determining the heating device temperature as one assumption may be made that the heating device is warm.

In one exemplary of the present invention heating device temperature may be regulated and/or the pressure roller temperature may be established based on one or a combination of factors. Such factors may include the heating device temperature prior to printing or at the beginning of a print job, the count of pages that have been printed already, whether the page to be printed may be simplex or duplex or whether the motors for feeding and/or transferring are still running.

The processor may therefore utilize a number of look up tables. The look-up tables may also correlate to the above described factors as well as the aspects of the printing device, such as media throughput. For example, where it is determined that the heating device is beginning from a cold start, the heating device may use temperatures from a first table, e.g., a cold-start look up table, that may be relatively high and allow for the pressure roller to heat up. Alternatively, where it is determined that the heating device is beginning from a cold start but more than a predetermined number of pages have already been printed, cooler heating device temperatures may be used as the pressure roller may already be relatively warm.

When it is determined that the heating device is beginning from a warm start, the heating device may use temperatures from a second table, e.g., a warm-start look up table that may then keep the pressure roller from overheating. Furthermore, if it is determined that the heating device is beginning from a warm start but there is a low page count, the heating device may be set to warmer temperatures.

It should be appreciated therefore, that as referred to herein, the cold-start look up table may include relatively warmer temperatures than the warm-start look up table under comparative conditions of printing. Furthermore, it should be appreciated that there may be more than two look up tables. For example, where a number of heating device states may be identified and printing may start from a number of modes such as cold start, warm start, hot start, etc. or cold start, warm up start, hot start, standby start or power save start.

Figure 2:
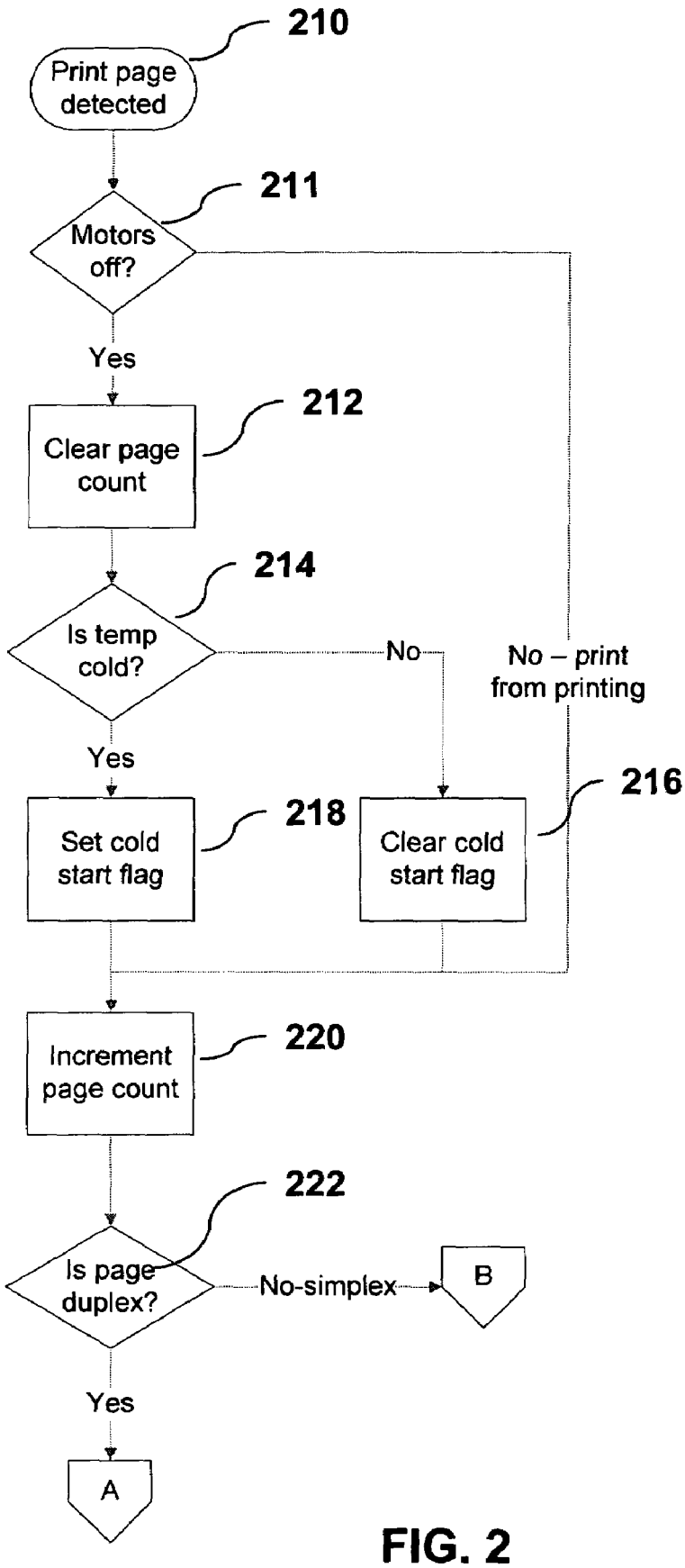
FIGS. 2, 3*a* and 3*b* provide a flow chart of an exemplary embodiment of the present invention.
Figure 3B:
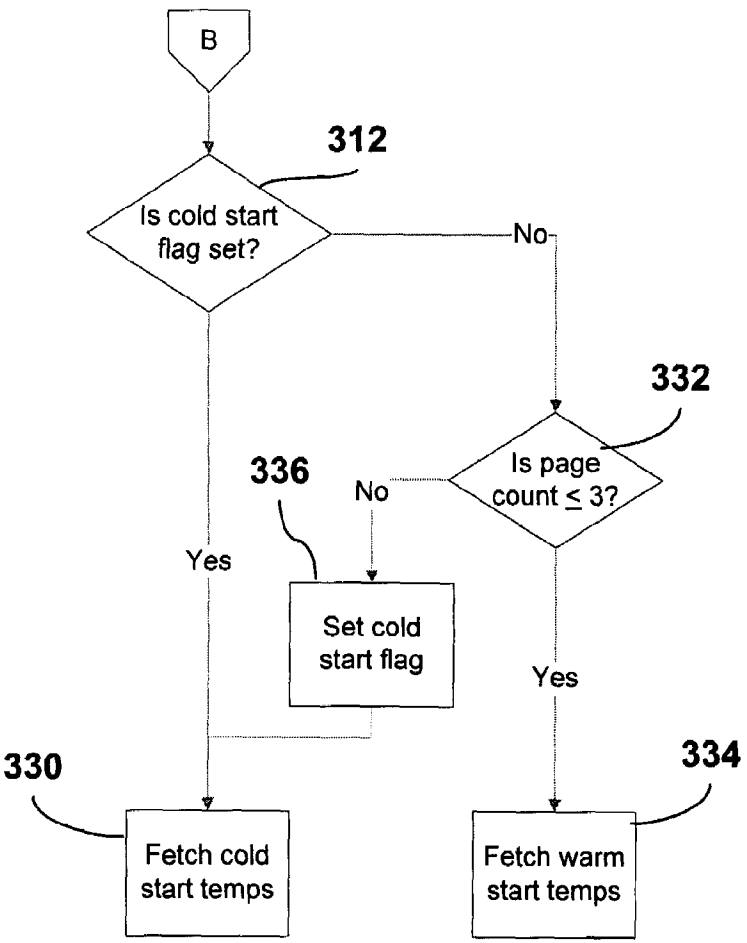
Figure 3A:
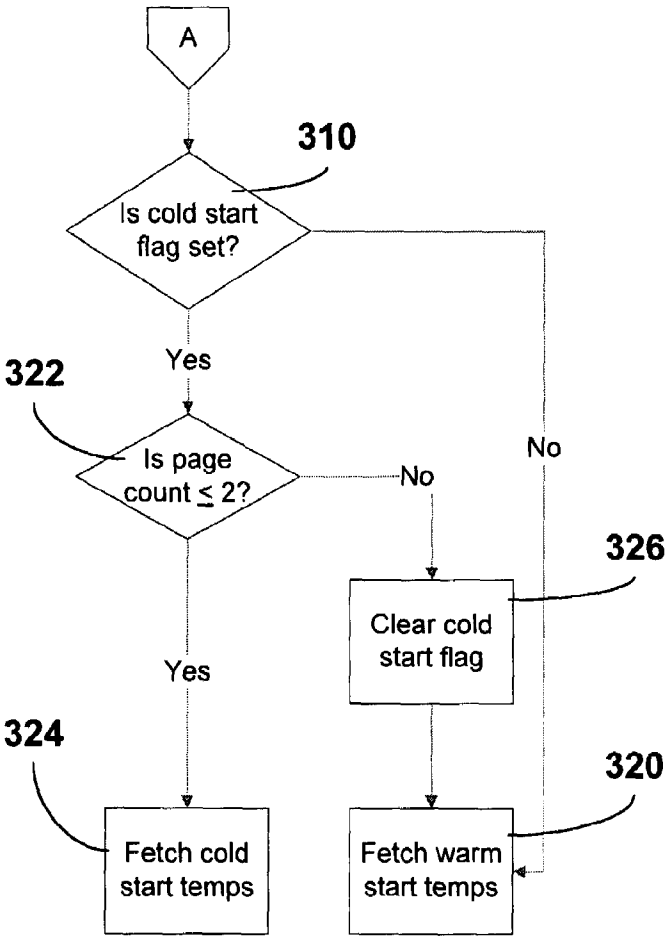

Illustrated in FIGS. 2, 3*a* and 3*b* is an exemplary embodiment of the present invention that illustrates some of the features noted above. For example, the processor may receive a print job and a print page signal may be detected, at 210. At 211 a determination may be made as to whether the feeding and/or transfer motor have been turned off. If the motors have been turned off, the process may clear the page count at 212. At 214 the processor may receive input from a temperature detecting element and determine whether the heating device temperature is above or below a set point. If the heating device temperature is above a set or desired temperature then a cold start flag may be cleared at 216 thereby indicating that the heating device is above the set point. If the heating device temperature is below a set or desired temperature, then a cold start flag may be set at 218.

The processor may then increment the page count by 1 at 220; however, it should be appreciated that the page count may be incremented at any point in the process. Furthermore, if it has been determined at 211 that the motor have not been turned off, then the process of determining heating device temperature may be skipped and the page count may be incremented directly at 220. A determination whether the page print is a simplex or a duplex may be made at 222. If the page is a duplex, then path A may be followed continuing on FIG. 3*a*. If the page is a simplex, then path B may be followed continuing on FIG. 3*b*.

For a duplex, illustrated in FIG. 3*a*, a determination may be made whether the cold start flag has been set at 310. If the cold start flag has not been set, and the heating device is considered warm, then the temperatures may be selected from the cooler temperatures on a warm-start temperature look up table at 320. If the cold start flag has been set, then the page count may be considered 322. If the page count is less than a set point number such as 2 at 322 then the temperatures may be selected from a grouping of temperatures in the cold-start temperature look up table at 324. If the page count is greater than 2 at 322, then the cold start flag may be cleared at 326 and heating device temperatures may be adjusted to temperatures correlating to a warm-start temperature table at 320. It should be appreciated that a page count of 2 was chosen as an example only and the page count may vary depending on a number of factors such as the type of media, the type of pressure roller used, the throughput of the media in the printing device, etc. Accordingly, in some situations, at block 322 a page count of any value greater than 1 may be used, including a page count of 4, 7, 10, etc.

For a simplex page, referring to FIG. 3*b*, a determination may be made whether the cold start flag has been set at 312. If the cold start flag has been set, then the processor may select temperatures that are relatively warmer to heat up the pressure roller and set the heating device according to a cold-start temperature look-up table at 330. If the cold start flag has not been set, then the page count may be determined at 332. Where the page count is lower than a given number, illustrated in this example as 3, cooler temperatures from the warm-start temperature look up table may be chosen 334. Where the page count is greater than a given number (e.g. any number greater than 1) the cold start flag may be set at 336 and temperatures may be chosen from a cold start temperature look up table. It should be appreciated that a page count of 3 was chosen as an example only and the page count may vary depending on a number of factors such as the type of media, the type of pressure roller used, the throughput of the media in the printing device, etc. Accordingly, in some situations, at block 332 a page count of any value greater than 1 may be used.

The foregoing description is provided to illustrate and explain the present invention. However, the description hereinabove should not be considered to limit the scope of the invention set forth in the claims appended here to.

What is claimed is:

1. A method of establishing the temperature of a component that engages a heating device in an image forming device comprising:

determining, at the beginning of a print job, whether a motor communicating with a media feeding device is running as a result of a previous print job;

identifying, at the beginning of the print job, a previous temperature of said heating device, comprising selectively assigning a predetermined temperature value as the previous temperature without detecting temperature, based upon the determining;

selecting the heating device temperature based upon said previous temperature of said heating device to establish said temperature of said component and upon whether said image forming device is printing simplex or duplex media wherein said heating device temperature is selected from a look-up table, wherein said heating device temperature is further set according to the pressure applied to said media by said component; and establishing said component temperature.

2. The method of claim 1, wherein said heating device temperature is selected from a plurality of look-up tables.

3. The method of claim 2 wherein said plurality of look-up tables comprise a first and second look-up table each including temperature ranges wherein said temperature range in said first look-up table is different than said temperature range in said second look-up table.

4. The method of claim 1, wherein said step of selecting a heating device temperature comprises determining whether or not said previous temperature is at or above a set point temperature.

5. The method of claim 1, wherein said step of selecting a heating device temperature comprises determining whether or not said previous temperature is at or below a set point temperature.

6. The method of claim 1, wherein said step of selecting said heating device temperature is based upon a page count.

7. The method of claim 6, wherein said heating device temperature is based on whether said page count is greater than a selected page count.

8. The method of claim 1, wherein selecting said heating device temperature is selected based upon whether said image forming device is printing simplex or duplex media.

9. The method of claim 6, wherein said page count is cleared based on whether said motor is turned off.

10. An image forming device which establishes the temperature of a component engaged with a heating device comprising:

a controller in communication with said heating device, wherein said controller is configured to select said heating device temperature based upon a previous temperature of said heating device to establish the temperature of said component and upon whether said image forming device is printing simplex or duplex media, and to determine, at the beginning of a print job, whether a motor communicating with a media feeding device is running as a result of a previous print job, wherein said heating device temperature is selected from a look-up table, wherein a predetermined temperature value is selectively used as the previous temperature, without performing any temperature measurement, based upon the determination of whether the motor is running at the beginning of the print job, and wherein said heating device temperature is further set according to the pressure applied to said media by said component.

11. The image forming device of claim 10, wherein said heating device temperature is selected from a plurality of look-up tables.

12. The image forming device of claim 11 wherein said plurality of look-up tables comprise a first and second look-up table each including temperature ranges wherein said temperature range in said first lookup table is different than said temperature range in said second lookup table.

13. The image forming device of claim 10, wherein said step of selecting a heating device temperature comprises determining whether or not said previous temperature is at or above a set point temperature.

14. The image forming device of claim 10, wherein said step of selecting a heating device temperature comprises determining whether or not said previous temperature is at or below a set point temperature.

15. The image forming device of claim 10, wherein said step of selecting said heating device temperature is based upon a page count.

16. The image forming device of claim 15, wherein said page count is cleared based on whether said motor is turned off.

17. The image forming device of claim 16, wherein said heating device temperature is based on whether said page count is greater than a selected page count.

18. The image forming device of claim 10, wherein selecting said heating device temperature is selected based upon whether said image forming device is printing simplex or duplex media.

19. A method of establishing the temperature of a component that engages a heating device in an image forming device comprising:

receiving a print page signal;

identifying when the print page signal is received a previous temperature of said heating device, and determining whether a motor communicating with a feeding device is running as a result of a previous print job, wherein a predetermined temperature value is selectively assigned as the previous temperature, without any temperature measurement, based upon the determining;

selecting the heating device temperature based upon said previous temperature of said heating device to establish said temperature of said component, wherein said step of selecting said heating device temperature is based upon a page count and whether said page print is a simplex or duplex, wherein said heating device temperature is further set according to the pressure applied to said media by said component; and establishing said component temperature.

20. The method of claim 19 wherein said heating device temperature is based on whether said page count is greater than a selected page count.

21. An image forming device which establishes the temperature of a component engaged with a heating device comprising:

a controller in communication with said heating device, wherein said controller is configured to select said heating device temperature based upon a previous temperature of said heating device to establish the temperature of said component wherein said step of selecting said heating device temperature is based upon a page count and upon whether said image forming device is printing simplex or duplex media, and to determine, at the beginning of a print job, whether a motor communicating with a media feeding device is running as a result of a previous print job, wherein a predetermined temperature value is selectively used as the previous temperature, without performing any corresponding temperature measurement, based upon the determination of whether the motor is running at the beginning of the print job and wherein said heating device temperature is further set according to the pressure applied to said media by said component.

22. The image forming device of claim 21 wherein said heating device temperature is based on whether said page count is greater than a selected page count.

* * * * *